US008679715B2

(12) United States Patent
Okita et al.

(10) Patent No.: US 8,679,715 B2
(45) Date of Patent: Mar. 25, 2014

(54) ELECTROSTATIC IMAGE DEVELOPING TONER, ELECTROSTATIC IMAGE DEVELOPER, IMAGE FORMING METHOD AND IMAGE FORMING APPARATUS

(75) Inventors: Masahiro Okita, Kanagawa (JP); Rieko Kataoka, Singapore (SG)

(73) Assignee: Fuji Xerox Co., Ltd., Tokyo (JP)

( * ) Notice: Subject to any disclaimer, the term of this patent is extended or adjusted under 35 U.S.C. 154(b) by 814 days.

(21) Appl. No.: 12/549,936

(22) Filed: Aug. 28, 2009

(65) Prior Publication Data

US 2010/0203443 A1 Aug. 12, 2010

(30) Foreign Application Priority Data

Feb. 12, 2009 (JP) ..... 2009-029391

(51) Int. Cl.
*G03G 9/08* (2006.01)

(52) U.S. Cl.
USPC ..... 430/108.3; 430/108.6; 430/108.7; 430/119.83; 430/119.86

(58) Field of Classification Search
USPC ..... 430/108.3, 109.4, 111.4, 108.7, 108.6, 430/119.83, 119.86
See application file for complete search history.

(56) References Cited

U.S. PATENT DOCUMENTS

| | | | | |
|---|---|---|---|---|
| 4,943,507 | A * | 7/1990 | Takahashi et al. | 430/123.41 |
| 4,960,665 | A * | 10/1990 | Elder et al. | 430/108.4 |
| 5,968,699 | A * | 10/1999 | Matsuzaki et al. | 430/111.35 |
| 6,096,465 | A * | 8/2000 | Kadokura et al. | 430/111.4 |
| 6,134,413 | A * | 10/2000 | Asanae et al. | 430/111.35 |
| 6,160,142 | A * | 12/2000 | Sawada et al. | 430/108.1 |
| 6,416,916 | B1 * | 7/2002 | Silence et al. | 430/108.3 |
| 7,371,495 | B2 * | 5/2008 | Sato | 430/108.1 |
| 8,163,450 | B2 * | 4/2012 | Kishida | 430/108.2 |
| 2002/0061457 | A1 * | 5/2002 | Okuno et al. | 430/108.7 |
| 2003/0134217 | A1 * | 7/2003 | Combes et al. | 430/108.11 |
| 2004/0219448 | A1 * | 11/2004 | Kato et al. | 430/108.6 |
| 2005/0208406 | A1 * | 9/2005 | Nozawa et al. | 430/108.6 |
| 2005/0214668 | A1 * | 9/2005 | Miyakawa et al. | 430/108.7 |
| 2008/0085459 | A1 | 4/2008 | Kami et al. | |
| 2008/0286668 | A1 * | 11/2008 | Ishigami et al. | 430/111.41 |

FOREIGN PATENT DOCUMENTS

| | | | | |
|---|---|---|---|---|
| CN | 101144989A7 | A | 3/2008 | |
| JP | A-60-198556 | | 10/1985 | |
| JP | A-61-231562 | | 10/1986 | |
| JP | A-61-231563 | | 10/1986 | |
| JP | A-2000-250251 | | 9/2000 | |
| JP | 2002214845 | A * | 7/2002 | G03G 9/113 |
| JP | 2003207942 | A * | 7/2003 | G03G 9/09 |

OTHER PUBLICATIONS

English language machine translation of JP 2002-214845 (Jul. 2002).*

English language machine translation of JP 2003-207942 (Jul. 2003).*

Diamond, Arthur S & David Weiss (eds.) Handbook of Imaging Materials, 2nd ed.. New York: Marcel-Dekker, Inc. (Nov. 2001) pp. 178-182.*

Dec. 13, 2012 Office Action issued in Chinese Patent Application No. 200910169062.4 (with translation).

* cited by examiner

*Primary Examiner* — Christopher Rodee
(74) *Attorney, Agent, or Firm* — Oliff PLC

(57) ABSTRACT

An electrostatic image developing toner includes a toner mother particle that contains a binder resin and a releasing agent; and an external additive that contains a zinc compound particle and a silica particle, wherein the zinc compound particle has a number average particle diameter of from about 2.0 μm to about 10.0 μm, the silica particle has a number average particle diameter of from about 60 nm to about 250 nm, the number of free zinc compound particles in all toner particles is from about 0.2% by number to about 1.0% by number, and the free zinc compound particle has an average circularity of about 0.6 or less.

17 Claims, 2 Drawing Sheets

ELECTROSTATIC IMAGE DEVELOPING TONER, ELECTROSTATIC IMAGE DEVELOPER, IMAGE FORMING METHOD AND IMAGE FORMING APPARATUS

CROSS-REFERENCE TO RELATED APPLICATIONS

This application is based on and claims priority under 35 USC 119 from Japanese Patent Application No. 2009-029391 filed on Feb. 12, 2009.

BACKGROUND

1. Technical Field

The present invention relates to an electrostatic image developing toner, an electrostatic image developer, an image forming method and an image forming apparatus.

2. Related Art

The mechanism widely used in an image forming apparatus utilizing an electrophotographic technique, such as copying machine and printer, includes a developing apparatus shown in FIG. 1, which performs a charging step of forming an electrostatic charge; a latent image forming step of forming an electrostatic latent image on a latent image holding member surface; a developing step of forming a toner image through a developing device equipped with a mechanism that conveys a developer containing an electrostatic latent image developing toner (hereinafter sometimes referred to as a "toner") by a development sleeve and develops the electrostatic latent image; a transfer step of transferring the toner image formed on the latent image holding member surface onto a transfer-receiving material surface such as paper or intermediate transfer material; and a fixing step of finally fixing the transferred toner image on an output medium, thereby forming an image. The latent image holding member above has a mechanism of returning again to the charging step through a cleaning step of collecting the residual material by scraping the surface with an elastic blade after the transfer step.

The cleaning member shown in FIG. 1 has a function of contacting an elastic blade with the residual material, thereby scraping it at the contact part (hereinafter sometimes referred to as a "blade nip"), and transferring the collected material to the collection vessel side.

The function required as the cleaning performance includes a fundamental function of removing a substance to be cleaned off, such as toner remaining on the latent image holding member surface, and further includes functions of, from the standpoint of prolonging the life, not scratching the latent image holding member surface and in view of generation of an image defect due to contamination, preventing a resin component such as toner binder resin or releasing agent from filming (adhering) by sliding at the abutting part.

SUMMARY

According to an aspect of the invention, there is provided an electrostatic image developing toner including a toner mother particle that contains a binder resin and a releasing agent; and an external additive that contains a zinc compound particle and a silica particle, wherein the zinc compound particle has a number average particle diameter of from about 2.0 μm to about 10.0 μm, the silica particle has a number average particle diameter of from about 60 nm to about 250 nm, the number of free zinc compound particles in all toner particles is from about 0.2% by number to about 1.0% by number, and the free zinc compound particle has an average circularity of about 0.6 or less.

BRIEF DESCRIPTION OF THE DRAWINGS

Exemplary embodiment(s) of the present invention will be described in detail based on the following figures, wherein.

DETAILED DESCRIPTION

Figure 1:
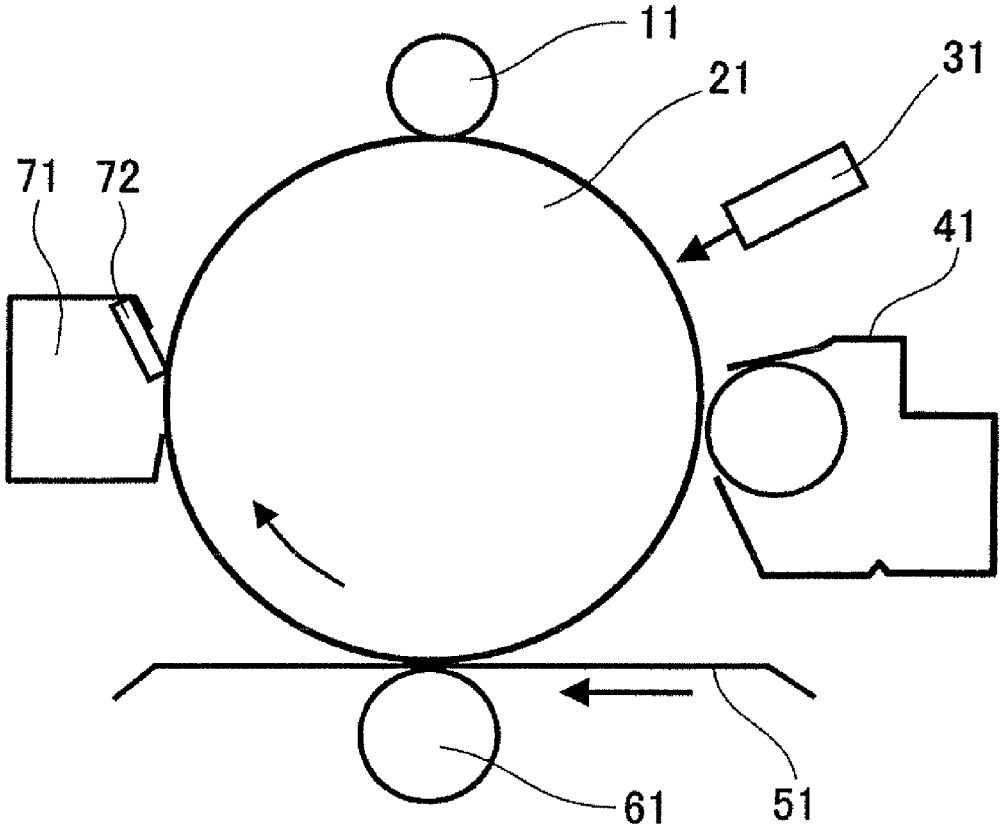
FIG. 1 is a cross-sectional schematic view from the side showing one example of the image forming apparatus.

The electrostatic image developing toner of the present invention includes a toner mother particle containing a binder resin and a releasing agent, and an external additive, wherein the external additive contains a zinc compound particle and a silica particle, the number average particle diameter of the zinc compound particle is from 2.0 μm to 10.0 μm or from about 2.0 μm to about 10.0 μm, the number average particle diameter of the silica particle is from 60 nm to 250 nm or from about 60 nm to about 250 nm, the number of free zinc compound particles in all toner particles is from 0.2% by number to 1.0% by number or from about 0.2% by number to about 1.0% by number, and the average circularity of the free zinc compound particle is 0.6 or less or about 0.6 or less.

Incidentally, in the present invention, the expression "from A to B" indicates a range containing not only the range between A and B but also both ends A and B. For example, when "from A to B" is a numerical range, this indicates "A or more and B or less" or "B or more and A or less".

With respect to the conventional toner, when an inorganic particle such as alumina is merely added to the toner as in the invention described in JP-A-2000-250251, despite high filming preventing effect, the latent image holding member surface is gradually abraded and this adversely affects the charging or latent image forming function in a long-term use, giving rise to a problem such as image quality defect.

With respect to the conventional toner, when a lubricant is merely added to the toner as in the inventions described in JP-A-60-198556, JP-A-61-231562 and JP-A-61-231563, because of a developability difference between the lubricant particle and the toner particle, it is difficult to always supply a constant amount of a lubricant to the blade nip position in a long-term use or in use under a high humidity environment. The cleaning property may be maintained by increasing the amount of the lubricant added, but this addition causes a problem such as image quality defect due to toner fogging in white part of an output image or filming of the lubricant itself on the latent image holding member surface. From the standpoint of stable supply of a lubricant, this problem can be overcome when a device for coating a lubricant on the latent image holding member surface is provided inside of the image forming apparatus separately from the developer, but there remains a problem in view of space-saving and cost.

The electrostatic image developing toner of the present invention contains a zinc compound and a silica particle as external additives and these particles are controlled to a certain particle diameter range, whereby the amount of the zinc compound particle liberated from the developer is controlled to a certain range. By continuously supplying the zinc compound particle to the blade nip part from the toner, the cleaning performance can be maintained over a long period of time.

In order to bring out the effect of the zinc compound particle liberated, the zinc compound particle needs to have a shape with an average circularity of 0.6 or less.

Also, in the case where a spherical silica obtained by a sol-gel method is used as the silica particle, this is preferred because variation in the liberated amount of the zinc compound particle can be reduced and the effect of the present invention can be more enhanced.

Furthermore, in the case of using a fatty acid zinc salt for the zinc compound, this is preferred because the sliding behavior of the cleaning blade is stabilized and a more excellent cleaning performance can be obtained.

In particular, according to the specification of the image forming apparatus, the toner composition is preferably adjusted within the range of the present invention such that when the amounts of zinc and carbon contained in the toner used and the amounts of zinc and carbon contained in the collected material collected in the cleaning part are measured by a fluorescent X-ray analysis, the Net intensity ratio between zinc Zn and carbon C (Zn/C) falls in the following range:

$$10 \leq R2/R1 \leq 30$$

wherein R1 is the Zn/C ratio of the toner and R2 is the Zn/C ratio of the collected material collected in the cleaning part. In this case, an image forming apparatus assured of excellent cleaning property over a long period of time even under a high humidity environment can be obtained.

The present invention is described in detail below.

<Electrostatic Image Developing Toner>

The electrostatic image developing toner of the present invention contains a toner mother particle containing a binder resin and a releasing agent, and an external additive and, if desired, contains a coloring agent and the like in the toner mother particle.

Usually, for controlling the flowability and electric chargeability, the electrostatic image developing toner is used by powder-mixing a particle generally called an external agent with a toner mother particle.

<Binder Resin>

In the electrostatic image developing toner of the present invention, a toner mother particle containing a binder resin is contained.

Examples of the binder resins include homopolymers and copolymers of styrenes such as styrene and chlorostyrene; monoolefins such as ethylene, propylene, butylene, and isoprene; vinyl esters such as vinyl acetate, vinyl propionate, vinyl benzoate and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone. In particular, typical examples of the binder resin include a polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, a polyethylene and a polypropylene. Other examples include a polyester resin, a polyurethane resin, an epoxy resin, a silicone resin, a polyamide resin, a modified rosin and paraffin waxes.

The binder resin preferably contains a polyester resin, more preferably contains a polyester resin in an amount of 50 wt % or more or about 50 wt % or more based on the entire amount of the binder resin.

<Releasing Agent>

In the electrostatic image developing toner of the present invention, a toner mother particle containing a releasing agent is contained.

Examples of the releasing agent include low molecular weight polyolefins such as polyethylene, polypropylene and polybutene; silicones exhibiting a softening temperature under heating; fatty acid amides such as oleic acid amide, erucic acid amide, ricinoleic acid amide and stearic acid amide; vegetable waxes such as ester wax, carnauba wax, rice wax, candelilla wax, Japan wax and jojoba oil; animal waxes such as bees wax; mineral waxes such as montan wax, ozokerite, ceresin, paraffin wax, microcrystalline wax and Fischer-Tropsch wax; petroleum waxes; and modified products thereof.

As for other materials added to the toner, a metal such as ferrite, magnetite, reduced iron, cobalt, nickel, and manganese, an alloy or oxide thereof, a magnetic material such as a compound containing the metal above, and a metal oxide such as alumina, titania and calcium carbonate, may be used.

As for the charge controlling agent, various charge controlling agents that are usually employed may be used, and examples thereof include a quaternary ammonium salt, a nigrosine-based compound, a dye composed of an aluminum, iron or chromium complex, and a triphenylmethane pigment.

<Coloring Agent>

The electrostatic image developing toner of the present invention may contain a coloring agent.

Examples of the coloring agent include various pigments such as carbon black, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, Rose Bengal, Aniline Blue, Ultramarine Blue, Calco Oil Blue, Methylene Blue Chloride, Phthalocyanine Blue, Phthalocyanine Green and Malachite Green Oxalate; and various dyes such as acridine type, xanthene type, azo type, benzoquinone type, azine type, anthraquinone type, thioindigo type, dioxazine type, thiazine type, azomethine type, indigo type, thioindigo type, phthalocyanine type, aniline black type, polymethine type, triphenylmethane type, diphenylmethane type, thiazine type, thiazole type and xanthene type.

One of these coloring agents may be used alone, or two or more thereof may be used in combination.

<External Additive>

In the electrostatic image developing toner of the present invention, a zinc compound particle and a silica particle are contained as external additives.

[Zinc Compound Particle]

Examples of the zinc compound for the zinc compound particle which can be used in the present invention include an inorganic compound such as zinc oxide, zinc hydroxide, zinc carbonate and zinc chloride, a fatty acid salt such as zinc laurate, zinc stearate and zinc linoleate, a zinc methacrylate, a zinc benzoate, and a complex such as zinc acetyl acetonate. Among these, a fatty acid zinc salt is preferred in the present invention.

The fatty acid zinc salt is a salt composed of, for example, a saturated fatty acid such as lauric acid, stearic acid and behenic acid or an unsaturated fatty acid such as oleic acid and linoleic acid, and zinc.

As for the fatty acid zinc salt which can be used in the present invention, in view of flowability, fixability and the like, those having a melting temperature of 40° C. to 200° C. or about 40° C. to about 200° C. are preferred. Above all, zinc stearate is preferred in the present invention.

The fatty acid zinc salt is not particularly limited in its production method and may be produced using a known method. For example, the fatty acid zinc salt can be synthesized by a method of performing cationic substitution of a fatty acid alkali metal salt such as sodium stearate, or a method of directly reacting a fatty acid and zinc hydroxide.

The zinc compound can be particulated by a known method, for example, using an apparatus of impact grinding the compound in a gas phase, such as ball mill, or a liquid-phase grinding apparatus of particulating the compound dispersed in a liquid, such as Gaulin homogenizer, ball mill and sand mill. The particle diameter can be adjusted using an apparatus such as sieve or air classification apparatus.

The number average particle diameter of the zinc compound particle is from 2.0 μm to 10.0 μm or from about 2.0 μm to about 10.0 μm, preferably from 2.2 μm to 10.0 μm or from about 2.2 μm to about 10.0 μm, more preferably from 2.5 μm to 4.5 μm or from about 2.5 μm to about 4.5 μm. A number average particle diameter exceeding 3.0 μm or about 3.0 μm is also preferred. If the number average particle diameter is less than 2.0 μm, desired effects can be hardly obtained probably because of high particle aggregating property, whereas if it exceeds 10.0 μm, the excessive supply from the developer leads to exhaustion in the long term and makes it difficult to uniformly supply the zinc compound particle over a long time and maintain the cleaning performance.

In the electrostatic image developing toner of the present invention, the content of the zinc compound particle is preferably from 0.05 part by weight to 3 parts by weight or about 0.05 part by weight to about 3 parts by weight, more preferably from 0.1 part by weight to 1.0 part by weight or from about 0.1 part by weight to about 1.0 part by weight, still more preferably from 0.1 part by weight to 0.5 part by weight or from about 0.1 part by weight to about 0.5 part by weight, yet still more preferably from 0.1 part by weight to 0.3 part by weight or from about 0.1 part by weight to about 0.3 part by weight, per 100 parts by weight of the toner mother particle.

[Silica Particle]

Silica used in the present invention indicates a compound containing silicon dioxide as the main compound and is not particularly limited in the crystal form, hydrated structure and the like.

The silica particle which can be used in the present invention is not particularly limited, and examples thereof include fumed silica by a combustion method, and a sol-gel process silica obtained by a wet method of granulating an alkoxysilane in water-alcohol by adding ammonia, but a spherical silica particle granulated by a sol-gel process is preferred.

The number average particle diameter of the silica particle is preferably measured using a laser diffraction/scattering particle size analyzer LA-920 (manufactured by Horiba Ltd.) under the condition of the relative refractive index of silica being 1.1 in a water-alcohol medium.

The number average particle diameter of the silica particle needs to be from 60 nm to 250 nm or from about 60 nm to about 250 nm and is preferably from 100 nm to 200 nm or from about 100 nm to about 200 nm. The silica particle in the toner of the present invention affects the amount of the zinc compound particle liberated, which is considered to be ascribable to the effect of electrostatic characteristics, and if the particle diameter is less than 60 nm, the amount of the zinc compound particle liberated becomes excessively large due to strong adherence between the silica particle and the toner and it is difficult to maintain the cleaning property for a long period of time, whereas if it exceeds 250 nm, an aggregate of silica particle and zinc compound particle is readily produced and it also becomes difficult to control the liberated amount.

In the electrostatic image developing toner of the present invention, the content of the silica particle is preferably from 0.05 part by weight to 3 parts by weight or from about 0.05 part by weight to about 3 parts by weight, more preferably from 0.1 part by weight to 1.0 part by weight or from about 0.1 part by weight to about 1.0 part by weight, still more preferably from 0.1 part by weight to 0.5 part by weight or from about 0.1 part by weight to about 0.5 part by weight, per 100 parts by weight of the toner mother particle.

The silica particle for use in the present invention is preferably spherical.

As for the definition of "spherical", the indicator therefor is assumed by the value determined as a Wadell sphericity according to the following formula:

Sphericity=(surface area of a particle having the same volume as that of actual particle)/(surface area of actual particle)

In the formula above, the numerator (surface area of a particle having the same volume as that of actual particle) is determined by calculation from the measurement results of particle size above, and the denominator (surface area of actual particle) is substituted by the BET specific surface area measured using a Shimadzu powder specific surface area analyzer Model SS-100.

In the present invention, the "spherical" is defined as having a sphericity of 0.6 or more.

[Other External Additives]

The electrostatic image developing toner of the present invention may contain an external additive other than the zinc compound particle and the silica particle.

Examples of the external additive other than the zinc compound particle and the silica particle include known external additives such as inorganic particle and organic particle. Above all, an inorganic particle such as titania, alumina, cerium oxide, strontium titanate, calcium carbonate, magnesium carbonate and calcium phosphate, and an organic resin particle such as fluorine-containing resin particle, silicone particle and nitrogen-containing resin particle are preferred. Also, the surface of the external additive may be subjected to a surface treatment using an alkylsilane coupling agent or the like for the purpose of hydrophobication.

The external additive other than the zinc compound particle and the silica particle is preferably a titania particle, more preferably a titania particle that is surface-treated with an alkylsilane coupling agent, still more preferably a titania particle that is surface-treated with a decylsilane coupling agent.

The number average particle diameter of the external additive other than the zinc compound particle and the silica particle is, in each of various external additives, preferably from 5 to 100 nm, more preferably from 5 nm to less than 60 nm.

<Free Zinc Compound Particle>

The amount of the free zinc compound particle contained in the electrostatic image developing toner of the present invention is preferably measured using a flow-type particle image analyzer FPIA-3000 (manufactured by Sysmex Corp.).

To speak specifically, it is particularly preferred, for example, that 40 mL of a toner is charged into a solution prepared by adding 0.5 mL of an aqueous 30 wt % sodium dodecylbenzenesulfonate solution to 50 mL of an aqueous 5 wt % sodium chloride solution, and mixed by means of a magnetic stirrer for 5 minutes by putting a stirring bar in the solution to uniformly disperse the toner, a sample where the total number of particles in the obtained toner liquid dispersion as counted by FPIA-3000 is set to 18,000 is measured, and regarding all of the photographed particles as all toner particles, the number of amorphous transparent particles out of all photographed particles, is counted as a free zinc compound particle, thereby calculating % by number of free zinc compound particles in the total count.

Amount (% by number) of free zinc compound. particles in toner=(number of amorphous transparent particles/total count 18,000)×100

In the electrostatic developing toner of the present invention, the amount of the free zinc compound particle in all toner particles needs to be from 0.2% by number to 1.0% by number or from about 0.2% by number to about 1.0% by number. If it is.less than 0.2% by number, the amount of the zinc compound particle reaching the cleaning-blade nip position is small and the effect of the present invention is not obtained, whereas if exceeds 1.0% by number, although excellent cleaning suitability is obtained in the initial stage, the excess supply leads to lack of the zinc compound in long-term use under high-humidity conditions and slippage of a toner image is likely to occur on the surface of a latent image holding member.

In the electrostatic image developing toner of the present invention, the free zinc compound particle has an average circularity of 0.6 or less or about 0.6 or less, that is, needs to have a certain degree of shape irregularity. If the average circularity exceeds 0.6, the zinc compound particle intrudes deeply into the blade nip position, as a result, image defects such as color streak is likely to appear.

Also, the average circularity of the free zinc compound particle is preferably from 0.4 to 0.6 or from about 0.4 to about 0.6.

As for the average circularity of the free zinc compound particle, it is preferred that only amorphous transparent particles measured above by FPIA-3000 are selected and the value of number average circularity is determined and used as the average circularity of the free zinc compound particle.

The volume average particle diameter $D_{50}$ of the toner of the present invention is preferably from 4 μm to 13 μm or from about 4 μm to about 13 μm, more preferably from 5 μm to 10 μm or from about 5 μm to about 10 μm. Also, the number average particle diameter of the toner of the present invention is preferably from 3 to 9 μm, more preferably from 4 to 6 μm.

The volume average particle diameter of the toner and the number average particle diameter of the zinc compound particle and the like are preferably measured using Multisizer Model 3 (manufactured by Beckman-Coulter, Corp.).

To speak specifically, it is preferred, for example, that powder particles as the measuring object are put in a beaker by using an aperture tube of 100 μm, an aqueous electrolyte solution (aqueous Isoton solution) is added thereto, the beaker is placed in ultrasonic cleaner to effect a dispersion treatment, an aqueous 10 wt % sodium dodecylbenzenesulfonate solution is added dropwise while performing the dispersion, and after uniformly dispersing the particles to be measured, the measurement is performed.

The volume average particle size distribution index GSDv of the toner is preferably 1.28 or less or about 1.28 or less. When GSDv is 1.28 or less, good performance in terms of sharpness and resolution of the image is obtained. On the other hand, the number average particle size distribution index GSDp is preferably 1.30 or less. When GSDp is 1.30 or less, the proportion of a small particle-diameter toner is low and the initial performance and reliability are good.

When the volume average particle size distribution index GSDv and the number average particle size distribution index GSDp are in the above-described ranges, a small-diameter component can be reduced and, for example, filming on a latent image holding member, toner cracking in a developing machine, toner blowout from a developing machine, and image quality deterioration due to charging failure can be suppressed.

The volume average particle size distribution index GSDv is preferably 1.25 or less or about 1.25 or less, and the number average particle size distribution index GSDp is preferably 1.25 or less.

An accumulated distribution of each of the volume and the number is drawn from the small diameter side with respect to the particle size range (channel) divided on the basis of particle size distribution measured as above, the particle diameter at 16% accumulation is defined as an accumulated volume average particle diameter $D_{16V}$ and an accumulated number average particle diameter $D_{16P}$, the particle diameter at 50% accumulation is defined as an accumulated volume average particle diameter $D_{50V}$ and an accumulated number average particle diameter $D_{50P}$, and the particle diameter at 84% accumulation is defined as an accumulated volume average particle diameter $D_{84V}$ and an accumulated number average particle diameter $D_{84}P$.

Here, the volume average particle size distribution index (GSDv) is specified as $(D_{84V}/D_{16V})^{1/2}$, and the number average particle size distribution index (GSDp) is specified as $(D_{84P}/D_{16P})^{1/2}$.

<Other Additives>

In the toner of the present invention, other than the components described above, various components such as internal additive, charge controlling agent, inorganic powder (inorganic particle) and organic particle maybe further added, if desired.

Examples of the internal additive include a magnetic material such as a metal (e.g., ferrite, magnetite, reduced iron, cobalt, nickel, manganese), an alloy thereof and a compound containing such a metal.

Examples of the charge controlling agent include a quaternary ammonium salt, a nigrosine-based compound, a dye composed of an aluminum, iron or chromium complex, and a triphenylmethane-based pigment.

The inorganic powder includes an inorganic particle added to a toner mother particle for the purpose of mainly adjusting the viscoelasticity of the toner, and examples thereof include all of inorganic particles usually used as an external additive on the toner surface, which are described in detail below, such as silica, alumina, titania, calcium carbonate, magnesium carbonate, calcium phosphate and cerium oxide.

The production method of the toner is not particularly limited, and a known production method may be used. Examples thereof include a kneading grinding method where the above-described toner constituent materials are kneaded, ground and classified; a method where the shape of the particle obtained by the kneading grinding method is modified using a mechanical impact force or a thermal energy; an emulsion polymerization aggregation method where a polymerizable monomer for a binder resin is emulsion-polymerized and the liquid dispersion formed is mixed with a releasing agent and if desired, with liquid dispersions of a coloring agent, a charge controlling agent and the like to obtain a toner mother particle through aggregation and heat fusion; a suspension polymerization method where a polymerizable monomer for obtaining a binder resin is suspended in an aqueous medium solvent together with a releasing agent and if desired, a solution containing a coloring agent, a charge controlling agent and the like and then polymerized; and a dissolution suspension method where a binder resin, a releasing agent and, if desired, a solution containing a coloring agent, an antistatic agent and the like are suspended in an aqueous solvent and the resulting suspension is granulated. In addition, a production method where a colored particle obtained by the method above is used as a core and an aggregating particle is further adhered and heat-fused to the core to form a core-shell structure, may also be used.

The mixing of the external additive may be performed using a known mixer such as V-blender, Henschel mixer or Redige mixer.

(Electrostatic Image Developer)

The electrostatic image developer of this embodiment (hereinafter sometimes referred to as the "developer") contains the electrostatic image developing toner of the present invention and according to the purpose, other components may be blended therein.

More specifically, the developer is prepared as a one-component electrostatic image developer when the electrostatic image developing toner of the present invention is used alone, and prepared as a two-component electrostatic image developer when used in combination with a carrier. In the case of a two-component electrostatic image developer, the toner concentration is preferably from 1 to 10 wt %.

<Carrier>

The carrier is preferably composed of at least a magnetic core particle and a resin component. Also, the carrier may be the same as or analogous to a conventionally known electrostatic image developing carrier and is not particularly limited.

Examples of the resin which can be used as the resin component contained in the carrier include a polyolefin-based resin such as polyethylene and polypropylene; a polyvinyl- or polyvinylidene-based resin such as polystyrene, acrylic resin, polyacrylonitrile, polyvinyl acetate, polyvinyl alcohol, polyvinyl butyral, polyvinyl chloride, polyvinyl carbazole, polyvinyl ether and polyvinyl ketone; a vinyl chloride-vinyl acetate copolymer; a styrene-acryl copolymer; a straight silicon resin composed of an organosiloxane bond, and a modification product thereof; a fluororesin such as polytetrafluoroethylene, polyvinyl fluoride, polyvinylidene fluoride and polychlorotrifluoroethylene; a polyester; a polyurethane; a polycarbonate; an amino resin such as urea-formaldehyde resin; and an epoxy resin. One of these resins may be used alone, or a plurality of these resins may be mixed and used. For the purpose of resistance control and antistatic control, an inorganic particle or a powder such as carbon black may be added.

Examples of the method for mixing a magnetic core particle and a carrier resin include a spray method of spraying the resin on the magnetic core particle surface, a fluid bed method of spraying a resin coat layer-forming solution in a state of the magnetic core particle being floated by an fluidizing air, a kneader coater method of mixing a magnetic core particle and a resin coat layer-forming solution in a kneader coater and then removing the solvent, and a dry coating method such as a powder coating method of heating or high-speed mixing a resin fine particle and a magnetic core particle, thereby coating the resin. According to the usage, these methods may be used in combination.

The core of the resin-coated carrier is preferably a shaped article of iron powder, ferrite, magnetite or the like, and the average diameter thereof is preferably from 30 to 200 μm or from about 30 to about 200 μm.

Examples of the coat resin for forming the coat layer include styrenes such as styrene, p-chlorostyrene and α-methylstyrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate; nitrogen-containing acryls such as dimethylaminoethyl methacrylate; vinyl nitrites such as acrylonitrile and methacrylonitrile; vinyl pyridines such as 2-vinylpyridine and 4-vinylpyridine; vinyl ethers such as vinyl methyl ether and vinyl isobutyl ether; vinyl ketones such as vinyl methyl ketone, vinyl ethyl ketone and vinyl isopropenyl ketone; olefins such as ethylene and propylene; a homopolymer of fluorine-containing vinyl-based monomer such as vinylidene fluoride, tetrafluoroethylene and hexafluoroethylene, or a copolymer composed of two or more kinds of these monomers; silicones such as methyl silicone and methylphenyl silicone; polyesters containing bisphenol, glycol or the like; an epoxy resin; a polyurethane resin; a polyamide resin; a cellulose resin; a polyether resin; and a polycarbonate resin. One of these resins may be used alone, or two or more thereof may be used in combination.

The amount of the coat resin is preferably from 0.1 part by weight to 10 parts by weight or from about 0.1 part by weight to about 10 parts by weight, more preferably from 0.5 part by weight to 3.0 parts by weight or from about 0.5 part by weight to about 3.0 parts by weight, per 100 parts by weight of the core. In the production of the carrier, a heating-type kneader, a heating-type Henschel mixer, a UM mixer or the like can be used. Depending on the amount of the coat resin, a heating-type fluid rolling bed, a heating-type kiln or the like can be used. In the electrostatic image developer, the mixing ratio between the toner and the carrier is not particularly limited and may be selected according to the purpose.

(Image Forming Method, Image Forming Apparatus)

The image forming method using the electrostatic image developing toner of the present invention is described below.

The image forming method using the toner of the present invention may utilize a known electrophotographic process but preferably includes a latent image forming step of forming an electrostatic latent image on a latent image holding member (sometimes referred to as a "photoreceptor") surface, a developing step of developing the electrostatic latent image formed on the latent image holding member surface with an electrostatic image developer to form a toner image, a transfer step of transferring the toner image formed on the latent image holding member surface onto a transfer-receiving material surface, a fixing step of fixing the toner image transferred onto the transfer-receiving material surface, and a cleaning step of collecting a residual material on the latent image holding member surface by means of a cleaning blade after the transfer step, and uses, as the electrostatic image developer, the electrostatic image developing toner of the present invention or the electrostatic image developer of the present invention.

Other than these steps, known steps utilized in the image forming method by an electrophotographic process may be combined. For example, the image forming method may contain a cleaning step of performing cleaning while collecting the toner remaining on the latent image holding member surface after completing the transfer step, or a toner recycling step of recycling the toner collected in the cleaning step as a toner for developer.

As for the image forming apparatus using the toner of the present invention, a known image forming apparatus can be utilized, but the image forming apparatus preferably includes a latent image holding member, a charging unit for electrostatically charging the latent image holding member, an exposure unit for exposing the electrostatically charged latent image holding member to form an electrostatic latent image on the latent image holding member, a developing unit for developing the electrostatic latent image with an electrostatic image developer to form a toner image, a transfer unit for transferring the toner image onto a transfer-receiving material from the latent image holding member, a fixing unit for fixing the toner image transferred onto the transfer-receiving material, and a cleaning unit containing a cleaning blade, and uses, as the electrostatic image developer, the electrostatic image developing toner of the present invention or the electrostatic image developer of the present invention.

<Latent Image Forming Step>

The latent image forming step here is a step of, after electrostatically charging the latent image holding member surface by the charging unit, exposing the latent image holding member, for example, by a laser optical system or an LED array to form an electrostatic latent. Examples of the charging unit include a non-contact type charger such as corotron and scorotron, and a contact type charger of applying a voltage to an electrically conductive member put into contact with the latent image holding member surface and thereby electrostatically charging the latent image holding member surface. Any type of a charger may be used, but a non-contact charging type charger is preferred in view of the effect of involving little ozone generation, being environment-friendly and exhibiting excellent printing durability. In the contact charging type charger, the shape of the electrically conducting member may be, for example, any of a brush, blade, pin electrode or roller form and is not limited. Incidentally, the latent image forming step is not limited only to the above-described embodiment.

<Developing Step>

The developing step is a step of bringing a developer holding member having formed on the surface thereof a developer layer containing at least a toner, into contact with or proximity to the latent image holding member surface and adhering the toner particles to the electrostatic latent image on the latent image holding member surface to form a toner image on the latent image holding member surface. As for the development system, a known system may be used, but in the case where the developer is a two-component developer, examples of the development system include a cascade system and a magnetic blush system. Incidentally, the development system is not limited only to the above-described embodiment.

<Transfer Step>

The transfer step is a step of transferring the toner image formed on the latent image holding member surface onto a recording medium. Other than the system of directly transferring the toner image onto a recording medium such as paper, the transfer step may employ a system of transferring the toner image onto a drum-like or belt-like intermediate transfer material and then transferring the image onto a recording medium such as paper. Incidentally, the transfer system is not limited only to the above-described embodiment.

As to the transfer apparatus for transferring the toner image onto paper or the like from the latent image holding member, for example, corotron may be utilized. The coroton is effective as a unit for electrostatically charging paper but in order to give a predetermined electric charge to the paper that is the recording medium, a voltage as high as several kV must be applied and a high-voltage power source is required. Also, ozone is generated by corona discharge and deteriorates rubber parts or the latent image holding member. For this reason, a contact transfer system of press-contacting an electrically conductive transfer roll formed of an elastic material to the latent image holding member and thereby transferring the toner image onto paper is preferred. Incidentally, the transfer apparatus is not limited only to the above-described embodiment.

<Cleaning Step>

The cleaning step is a step of bringing a cleaning blade into direct contact with the latent image holding member surface and thereby removing the toner, paper powder, dust and the like adhering to the latent image holding member surface.

The cleaning blade is preferably an elastomer blade such as blade made of rubber (e.g., polyurethane).

<Fixing Step>

The fixing step is a step of fixing the toner image transferred onto the recording medium surface by a fixing apparatus. As for the fixing apparatus, a heat-fixing apparatus using a heat roll is preferably used. The heat-fixing apparatus consists of a fixing roller including a heater lamp for heating in the inside of a cylindrical core metal and having a so-called release layer formed around the outer circumferential surface by a heat-resistant resin coat layer or a heat-resistant rubber coat layer; and a pressure roller or pressure belt disposed in pressure-contact with the fixing roller and prepared by forming a heat-resistant elastic material-containing layer on the outer circumferential surface of a cylindrical core metal or on the surface of a belt-like substrate. In the fixing process for a toner image, a recording medium having formed thereon a toner image is passed through a contact part formed by the fixing roller and the pressure roller or pressure belt, whereby the toner image is fixed by heat melting of the binder resin, additive and the like in the toner. However, the fixing method is not limited only to the above-described embodiment.

In the case of forming a full color image, the image forming apparatus includes a plurality of image holding members each containing a color developer holding member, and the image forming method is preferably a method where a series of steps consisting of a latent image forming step, a developing step, a transfer step and a cleaning step are performed by each of the plurality of image holding members or developer holding members, thereby sequentially stacking and forming color toner images on the same recording medium surface every time when the series of steps are completed, and the full color toner image as a stack is heat-fixed in the fixing step.

In this regard, when the electrostatic image developing toner of the present invention or the electrostatic image developer of the present invention is used in the above-described image forming method, for example, stable performances of development, transfer and fixing can be obtained even in a tandem system that is suitable for a small processor or high-speed color processing.

The construction of the toner recycling unit for implementing the toner recycling step is not particularly limited, but examples thereof include a method where the toner collected in the cleaning part is conveyed to a toner supply hopper or developing device by means of a transport conveyer or transport screw or is mixed with a supply toner in an intermediate chamber and then supplied to a developing device housing a developer. A system of returning the collected toner directly to a developing device, or a system of mixing the recycle toner with a supply toner in an intermediate chamber and then supplying the toner is preferred.

The image forming apparatus preferably further includes a cleaning unit for performing cleaning while collecting the toner remaining on the latent image holding member surface after the toner image is transferred, and a toner recycling unit for recycling the toner collected by the cleaning unit as a toner for use in the electrostatic image developer.

In the image forming apparatus having the above-described construction, a toner cartridge detachable from the image forming apparatus and housing an electrostatic image developing toner for supplying the toner to a toner image forming unit may be used. Furthermore, a process cartridge detachable from the image forming apparatus and including at least a latent image holding member and a toner image forming unit for housing an electrostatic image developer and at the same time, supplying the electrostatic image developer to an electrostatic latent image formed on the latent image holding member surface to form a toner image, may be used.

The process cartridge is, as described above, a single unit including at least a latent image holding member and a toner image forming unit and being freely detachable from the main body of the apparatus but, other than these, may include a charging unit, an exposure unit, a cleaning unit and the like.

As regards the recording medium onto which the toner image is transferred, for example, plain paper used for a copying, machine or printer in an electrophotographic system, OHP sheet, coated paper obtained by coating a surface of plain paper with a resin or the like, and art paper for printing may be used.

In the image forming method of the present invention, the Net intensity ratio between zinc Zn and carbon C (Zn/C) as measured by a fluorescent X-ray analysis preferably satisfies the following relationship:

$$10 \leq R2/R \leq 45$$

wherein R1 is the Zn/C ratio of the toner and R2 is the Zn/C ratio of the collected material collected in the cleaning step, more preferably satisfies the following relationship:

$$10 \leq R2/R \leq 30$$

still more preferably satisfies the following relationship:

$$18 \leq R2/R1 \leq 25$$

When the R2/R1 value is in the range above, the amount of the zinc compound particle supplied to the cleaning blade nip part is proper, so that excellent cleaning property can be exhibited and generation of filming on the latent image holding member can be suppressed.

As for the measurement of the toner and collected material, in the case where in the image forming apparatus, a cleaning and collecting vessel is cleaned and an output test of consuming about 100 g of toner is practiced, two samples, that is, the used toner itself and the collected material collected from the collecting vessel, are subjected to the above-described fluorescent X-ray analysis, whereby the amounts in respective samples can be determined.

Figure 2:
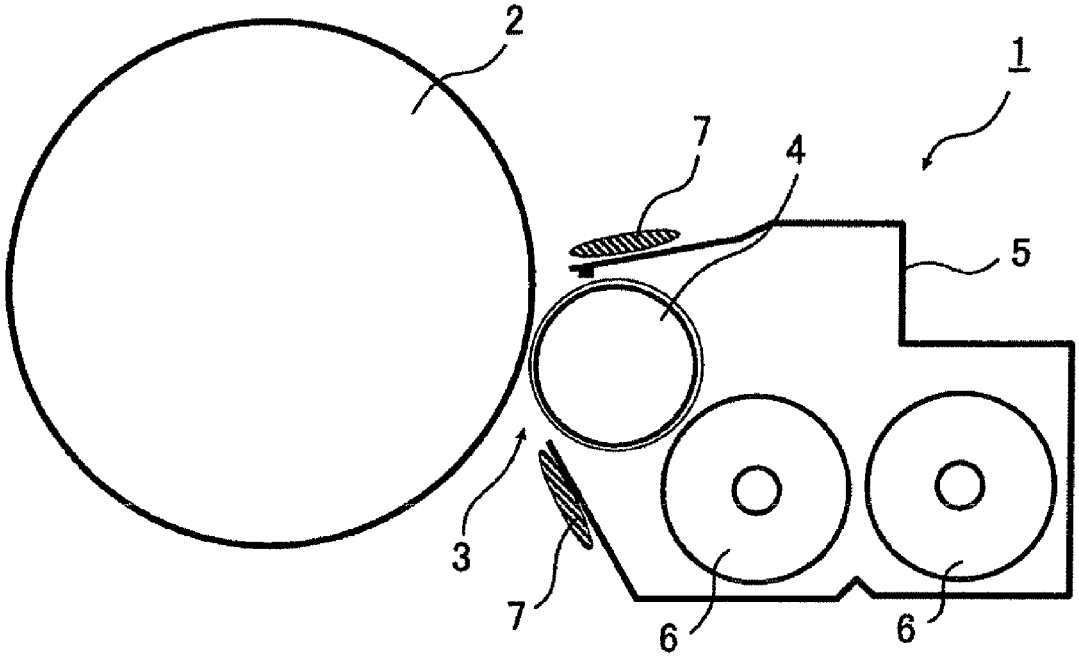
FIG. 2 is a cross-sectional schematic view showing one example of the developing apparatus, wherein denotes Developing apparatus, 2 denotes Electrostatic latent image holding member, 3 denotes Opening for development, 4 denotes Developing roll, 5 denotes Development housing, 6 denotes Stirring device, 7 denotes Free toner, 11 denotes Charging apparatus, 21 denotes Latent image holding member, 31 denotes Latent image forming apparatus, 41 denotes Developing apparatus, 51 denotes Transfer-receiving material, 61 denotes Transfer apparatus, 71 denotes Cleaning collecting apparatus, and 72 denotes Cleaning blade.

As for the collected material, in the developing apparatus shown in FIG. 2, the toner blown out and attached to the top and bottom housing surfaces at an opening 3 of a development sleeve is the collected material.

The collected material is preferably a collected material after outputting 20,000 sheets of a test chart having a solid image of 1.2 cm×17.0 cm (width) (the side in the output direction is a long side) at a position of 4 cm, 14 cm or 23 cm from the top end in the longitudinal direction of an A4-size sheet, more preferably a collected material after outputting 40,000 sheets, still more preferably a collected material after outputting 60,000 sheets.

Also, the collected material is preferably a collected material collected after modifying a complex machine DocuCentre Color f450 (manufactured by Fuji Xerox Co., Ltd.), removing all the contained developer, filling the toner and the developer in the cyan toner cartridge and the developing device, and performing an output operation in the apparatus.

FIG. 2 is a cross-sectional schematic view showing one example of the developing apparatus.

Conventionally, the developing apparatus 1 used in an image forming apparatus such as copying machine and printer using an electrophotographic technique generally includes a development housing 5 having an opening 3 for development provided to oppose an electrostatic latent image holding member 2 such as photoreceptor, and a developer holding member such as developing roll 4 disposed to face the opening 3 for development, where the developer housed in the development housing 5 is carried on the developing roll 4 while stirring the developer with a stirring device 6 and conveyed to the development region facing the opening 3 for development and an electrostatic latent image on the electrostatic latent image holding member 2 is thereby visualized.

In such a developing apparatus 1, a free toner (toner cloud) 7 of the electrostatic image developer flows to the outside from a gap between the opening 3 for development of the development housing 5 and the developing roll 4 during development operation.

The R2/R1 value measured by collecting the free toner as the collected material is controlled to a specific range, whereby at the image formation, excellent cleaning property can be exhibited and generation of filming on the latent image holding member can be suppressed.

The measuring method by fluorescent X-ray analysis is described in detail below. The measurement of the Net intensity ratio between zinc Zn and carbon C by fluorescent X-ray analysis is preferably performed by the following method.

As the pretreatment of a sample, 150 mg of a sample is precisely weighed and pressure-molded at 5 t/cm$^2$ for 1 minute in a pressure molding device to produce a disc-like measurement sample of 10 mm in diameter.

The molded sample is measured for the Net intensity (kcps) value that is the X-ray yield derived from each element, by a wavelength dispersion-type fluorescent X-ray analyzer XRF-1500 (manufactured by Shimadzu Corporation) under the measurement conditions of Rh target, tube voltage of 40 KV, tube current of 70 mA and measurement time of 30 minutes.

The value of (Net intensity value of zinc Zn)÷(Net intensity value of carbon C) is calculated from the measurement results and defined as a Net intensity ratio (Zn/C).

EXAMPLES

The present invention is described in greater detail below by referring to Examples, but the present invention is not limited to these Examples by any means. In the following, the "parts" means "parts by weight".

<Production of Zinc Compound Particle>

To a mixture obtained by adding 1,145 parts of stearic acid to 5,000 parts of ethanol and mixing these at 75° C., 200 parts of zinc. hydroxide is gradually added and mixed for 1 hour from the completion of addition. After mixing, the mixture is cooled to 20° C., the product is separated by filtration, ethanol and the reaction residue are removed, and the produced solid taken out is dried at 150° C. for 3 hours in a heating-type vacuum dryer, taken out from the dryer and then allowed to cool to obtain solid zinc stearate.

The solid zinc stearate is ground by a jet mill and then classified by an elbow jet classifier (manufactured by Matsubo Corporation) at classification cut points of 3.5 μm and 5.1 μm to obtain Powdery Zinc Stearate 1 having a number average particle diameter of 4.2 μm.

In the production method of Zinc Stearate 1, the classification cut point is changed to obtain Zinc Stearate 3 having a number average particle diameter of 9.5 μm (cut points: 8 μm and 10.5 μm) and Zinc Stearate 5 having a number average particle diameter of 10.5 μm (cut points: 10 μm and 13 μm).

Also, in the production method of Zinc Stearate 1, grinding by a jet mill is repeated to increase the fine powder amount and the classification cut point is changed to obtain Zinc Stearate 2 having a number average particle diameter of 2.3 μm (cut points: 1.8 μm and 3 μm) and Zinc Stearate 4 having a number average particle diameter of 1.8 μm (cut points: 1 μm and 2 μm).

Zinc Stearate 1 is mixed with an aqueous dodecylbenzenesulfonic acid solution and pulverized by a Goulin homogenizer 15 MR-8TA (manufactured by Doei Shoji K.K.), and the liquid dispersion is taken out and subjected to separation by filtration, washing and drying in a vacuum freezing dryer to obtain Zinc Stearate 6 having a number average particle diameter of 3.8 μm. The morphology is observed by an optical microscope, as a result, a large proportion of particles having a smooth morphology are found in the particles of Zinc Stearate 6.

<Production of Silica Particle>

A stirrer, a dropping funnel and a thermometer are set in a glass-made reaction vessel, and 640 parts of methanol, 360 parts of ion-exchanged water and 145 parts of 25% aqueous ammonia are added and stirred at an adjusted temperature of 20° C. To the resulting mixed solution, 760 parts of tetramethoxysilane is added dropwise over 1 hour. After the dropwise addition, the liquid temperature in the system is adjusted to 35° C. and a stirring operation (1) is continued for 4 hours to produce a silica sol. Thereafter, 1,000 parts of ion-exchanged water is added and mixed, the supernatant resulting from centrifugal separation is removed, 1,000 parts of ion-exchanged water is again added, and methanol is removed by heating the system at 90° C. while mixing the solution to obtain Silica Sol Suspension (A).

Silica Sol Suspension (A) after removal of methanol is added with 2,000 parts of methyl isobutyl ketone and concentrated by heating at 105° C. to remove water, whereby Silica Sol Suspension (B) based on methyl isobutyl ketone is obtained.

Subsequently, Silica Sol Suspension (B) is added with 88 parts of hexamethyldisilazane, hydrophobed at 110° C. for 3 hours, transferred to a rotary evaporator and dried under reduced pressure at 80° C., and the solid taken out is ground by a sample mill and further subjected to grinding and removal of coarse powder through a 200-mesh stainless steel sieve by using a sonic sieving device to obtain Sol-Gel Silica 1.

So-Gel Silica 1 is found to have a number average particle diameter of 150 nm and a sphericity of 0.7.

Sol-Gel Silica 2 having a number average particle diameter of 65 nm and a sphericity of 0.7 is obtained by changing the time of the stirring operation (1) to 1 hour in the production process of Sol-Gel Silica 1.

Sol-Gel Silica 3 having a number average particle diameter of 240 nm and a sphericity of 0.6 is obtained by changing the time of the stirring operation (1) to 6 hours in the production process of Sol-Gel Silica 1.

Production of Silica Particles for Comparative Examples

Sol-Gel Silica 4 having a number average particle diameter of 40 nm and a sphericity of 0.6 is obtained by changing the time of the stirring operation (1) to 25 minutes in the production process of Sol-Gel Silica 1.

Sol-Gel Silica 5 having a number average particle diameter of 300 nm and a sphericity of 0.6 is obtained by changing the time of the stirring operation (1) to 9 hours in the production process of Sol-Gel Silica 1.

<Toner Mother Particle 1>

20 Parts by weight of C.I. Pigment Blue 15:3, 75 parts by weight of ethyl acetate, 4 parts by weight of Disparlon DA-703-50 (polyester acid amide amine salt, produced by Kusumoto Chemicals, Ltd.) from which the solvent is removed, and 1 part by weight of Solsperse 5000 (pigment derivative, produced by Zeneca) are dissolved/dispersed to produce a pigment liquid dispersion.

As the releasing agent, 30 parts by weight of paraffin wax (melting temperature: 89° C.) and 270 parts by weight of ethyl acetate are wet ground in a state of being cooled to 10° C., by using a DCP mill (manufactured by Buehler AG, Dry SuperFlow) to produce a wax liquid dispersion.

136 Parts by weight of polyester resin (composed of, as monomer raw materials, bisphenol A propylene oxide adduct and ethylene oxide adduct, ethylene glycol, terephthalic acid, isophthalic acid, fumaric acid and adipic acid; Mw: 31,000, Tg: 60° C., softening temperature: 115° C.), 34 parts by weight of the pigment liquid dispersion and 56 parts by weight of ethyl acetate are stirred, 75 parts by weight of the wax liquid dispersion is added thereto, and these are thoroughly stirred until becoming uniform (this liquid is designated as Solution A).

124 Parts by weight of calcium carbonate liquid dispersion prepared by dispersing 40 parts by weight of calcium carbonate fine particle having a number average particle diameter of 0.2 μm in 60 parts by weight of water, 99 parts by weight of an aqueous 2% CELLOGEN BS-H (produced by Dai-ichi Kogyo Seiyaku Co., Ltd.) solution and 157 parts by weight of water are stirred for 5 minutes by using a homogenizer (Ultraturrax, manufactured by IKA Works, Inc.) (this liquid is designated as Solution B).

Subsequently, 250 parts by weight of Solution A is added to 345 parts by weight of Solution B under stirring at 10,000 rpm with a homogenizer (Ultraturrax, manufactured by IKA Works, Inc.), and the mixed solution is suspended by stirring for 1 minute and then stirred using a propeller-type stirrer at room temperature under atmospheric pressure to remove the solvent. After adding hydrochloric acid and removing calcium carbonate, addition and mixing of ion-exchanged water and water washing by filtration are repeated until the electrical conductivity of the filtrate becomes 2 μS/cm, and the resulting particle is dried by a vacuum dryer. Fine powder and coarse powder are removed using an elbow jet classifier to obtain Cyan Toner Mother Particle 1 having an average particle diameter of 7.2 μm.

<Production of Carrier 1>

| | |
|---|---|
| Mn—Mg Ferrite particle (volume average particle diameter = 40 μm) | 1,000 parts by weight |
| Styrene (St)/methyl methacrylate (MMA) resin (copolymerization ratio: 25:75, Mw: 80,000) | 23 parts by weight |

-continued

| | |
|---|---|
| Carbon black | 2 parts by weight |
| Toluene | 400 parts by weight |

The composition above is charged into a vacuum heating-type kneader, mixed and dried under reduced pressure while heating at 70° C. The obtained powder is classified by an SUS sieve for a particle size of 200 mesh to obtain Carrier 1.

Production of Toners for Examples and Comparative Examples

The toner mother particle and respective materials are mixed in the following ratio at 3,000 rpm for 3 minutes by a Henschel mixer to obtain each toner.

Toner for Example 1

| | |
|---|---|
| Toner Mother Particle 1 | 100 parts by weight |
| Titania particle having a number average particle diameter of 20 nm hydrophobed with a decylsilane coupling agent (AX43-045, produced by Shin-Etsu Chemical Co., Ltd.) | 1.0 part by weight |
| Zinc Stearate 1 | 0.2 part by weight |
| Sol-Gel Silica 1 | 0.5 part by weight |

The toner for Example 1 is found to have a free zinc compound particle amount of 0.45% by number and an average circularity of 0.45.

Toner for Example 2

| | |
|---|---|
| Toner Mother Particle 1 | 100 parts by weight |
| Titania particle having a number average particle diameter of 20 nm hydrophobed with a decylsilane coupling agent used in Example 1 | 1.0 part by weight |
| Zinc Stearate 1 | 0.2 part by weight |
| Sol-Gel Silica 2 | 0.5 part by weight |

The toner for Example 2 is found to have a free zinc compound particle amount of 0.8% by number and an average circularity of 0.48.

Toner for Example 3

| | |
|---|---|
| Toner Mother Particle 1 | 100 parts by weight |
| Titania particle having a number average particle diameter of 20 nm hydrophobed with a decylsilane coupling agent used in Example 1 | 1.0 part by weight |
| Zinc Stearate 1 | 0.2 part by weight |
| Sol-Gel Silica 3 | 0.5 part by weight |

The toner for Example 3 is found to have a free zinc compound particle amount of 0.35% by number and an average circularity of 0.42.

Toner for Example 4

| | |
|---|---|
| Toner Mother Particle 1 | 100 parts by weight |
| Titania particle having a number average particle diameter of 20 nm hydrophobed with a decylsilane coupling agent used in Example 1 | 1.0 part by weight |
| Zinc Stearate 2 | 0.2 part by weight |
| Sol-Gel Silica 1 | 0.5 part by weight |

The toner for Example 4 is found to have a free zinc compound particle amount of 0.21% by number and an average circularity of 0.52.

Toner for Example 5

| | |
|---|---|
| Toner Mother Particle 1 | 100 parts by weight |
| Titania particle having a number average particle diameter of 20 nm hydrophobed with a decylsilane coupling agent used in Example 1 | 1.0 part by weight |
| Zinc Stearate 3 | 0.2 part by weight |
| Sol-Gel Silica 1 | 0.5 part by weight |

The toner for Example 5 is found to have a free zinc compound particle amount of 0.95% by number and an average circularity of 0.41.

Toner for Comparative Example 1

| | |
|---|---|
| Toner Mother Particle 1 | 100 parts by weight |
| Titania particle having a number average particle diameter of 20 nm hydrophobed with a decylsilane coupling agent used in Example 1 | 1.0 part by weight |
| Zinc Stearate 1 | 0.2 part by weight |
| Sol-Gel Silica 4 | 0.5 part by weight |

The toner for Comparative Example 1 is found to have a free zinc compound particle amount of 1.40% by number and an average circularity of 0.47.

Toner for Comparative Example 2

| | |
|---|---|
| Toner Mother Particle 1 | 100 parts by weight |
| Titania particle having a number average particle diameter of 20 nm hydrophobed with a decylsilane coupling agent used in Example 1 | 1.0 part by weight |
| Zinc Stearate 1 | 0.2 part by weight |
| Sol-Gel Silica 5 | 0.5 part by weight |

The toner for Comparative Example 2 is found to have a free zinc compound particle amount of 0.18% by number and an average circularity of 0.55.

Toner for Comparative Example 3

| | |
|---|---|
| Toner Mother Particle 1 | 100 parts by weight |
| Titania particle having a number average particle diameter of 20 nm hydrophobed with a decylsilane coupling agent used in Example 1 | 1.0 part by weight |
| Zinc Stearate 4 | 0.2 part by weight |
| Sol-Gel Silica 1 | 0.5 part by weight |

The toner for Comparative Example 3 is found to have a free zinc compound particle amount of 0.13% by number and an average circularity of 0.52.

Toner for Comparative Example 4

| | |
|---|---|
| Toner Mother Particle 1 | 100 parts by weight |
| Titania particle having a number average particle diameter of 20 nm hydrophobed with a decylsilane coupling agent used in Example 1 | 1.0 part by weight |
| Zinc Stearate 5 | 0.2 part by weight |
| Sol-Gel Silica 1 | 0.5 part by weight |

The toner for Comparative Example 4 is found to have a free zinc compound particle amount of 1.30% by number and an average circularity of 0.35.

Toner for Comparative Example 5

| | |
|---|---|
| Toner Mother Particle 1 | 100 parts by weight |
| Titania particle having a number average particle diameter of 20 nm hydrophobed with a decylsilane coupling agent used in Example 1 | 1.0 part by weight |
| Zinc Stearate 6 | 0.2 part by weight |
| Sol-Gel Silica 1 | 0.5 part by weight |

The toner for Comparative Example 5 is found to have a free zinc compound particle amount of 0.82% by number and an average circularity of 0.68.

Toner for Example 6

| | |
|---|---|
| Toner Mother Particle 1 | 100 parts by weight |
| Titania particle having a number average particle diameter of 20 nm hydrophobed with a decylsilane coupling agent used in Example 1 | 1.0 part by weight |
| Zinc Stearate 1 | 0.5 part by weight |
| Sol-Gel Silica 1 | 0.5 part by weight |

The toner for Example 6 is found to have a free zinc compound particle amount of 0.95% by number and an average circularity of 0.43.

Toner for Example 7

| | |
|---|---|
| Toner Mother Particle 1 | 100 parts by weight |
| Titania particle having a number average particle diameter of 20 nm hydrophobed with a decylsilane coupling agent used in Example 1 | 1.0 part by weight |
| Zinc Stearate 1 | 0.35 part by weight |
| Sol-Gel Silica 1 | 0.5 part by weight |

The toner for Example 7 is found to have a free zinc compound particle amount of 0.77% by number and an average circularity of 0.44.

A list of respective toners is shown in Table 1 later.

<Preparation of Developer for Evaluation>

The toners of Examples and Comparative Examples each is mixed in a ratio of 7 parts by weight of toner to 100 parts by weight of Carrier 1 by using a V-blender at room temperature of 25° C. at 40 rpm for 20 minutes, and the resulting mixture is sieved through a 150-mesh SUS sieve (opening: 106 mm) to obtain a developer for evaluation.

<Evaluation>

For the evaluation of image output, a complex machine DocuCentre Color f450 (manufactured by Fuji Xerox Co., Ltd.) which is modified and in which all the contained developer is removed and the toner and developer for Examples and Comparative Examples are filled in the cyan toner cartridge and the developing device, is used as the evaluation test apparatus (hereinafter sometimes referred to as a "complex machine for evaluation").

As for the paper, an A4-size sheet (C2 paper produced by Fuji Xerox Co., Ltd.) is used, and a printing test is performed by the output of A4 transverse feed mode.

As for the evaluation print image, a solid image of 1.2 cm×7.0 cm (width) (the side in the output direction is a long side) at a position of 4 cm, 14 cm or 23 cm from the top end in the longitudinal direction of an A4-size sheet is output as a test chart.

The image density is measured using X-Rite 938 (manufactured by Nippon Heiban Kizai K.K.), and the average value of 5 measurements in the objective region is used as the image density.

As for the adjustment of image density, the image density is adjusted to become ID=1.25 to 1.55 based on the density measurement results of the print image every time when 1,000 sheets are printed.

In the evaluation, the complex machine for evaluation after setting the toner for test and the developer is left standing in an environmental room at a temperature of 28° C. and a humidity of 85% for 8 hours, and then an output test is performed by the following procedure:

(1) 10,000 prints are output in an environmental room at a temperature of 28° C. and a humidity of 85%, (2) the complex machine for evaluation is moved to an environmental room at a temperature of 25° C. and a humidity of 60% and 10,000 prints are further output, and (3) the complex machine is moved to an environmental room at a temperature of 28° C. and a humidity of 85% and left standing for 8 hours.

The printing test of 20,000 sheets in (1) to (3) above is taken as 1 cycle, and an output test of 60,000 sheets in total of 3 cycles is performed.

The cleaning part is removed at the end of each cycle, and the collected material is subjected to fluorescent X-ray analysis. The cleaning part is cleaned and then again set in the complex machine.

<Evaluation Index>

(Color Streak Contamination)

The output image on the initial 10th print in each cycle is used as the sample for image evaluation, and the presence or absence of color streak contamination is judged according to the following indices.

A: Color streak contamination is not generated.

B: Color streak contamination is not recognized with an eye but can be faintly observed through a magnifier.

C: Slight color streak contamination can be recognized with an eye.

D: Clear color streak contamination can be recognized with an eye.

(Image Slippage)

The output image on the initial 10th print in each cycle is used as the sample for image evaluation, and the presence or absence of image slippage is judged according to the following indices.

A: Image slippage is not generated.

B: Image slippage is not recognized with an eye but can be faintly observed through a magnifier.

C: Slight image slippage can be recognized with an eye.

D: Clear image slippage can be recognized with an eye.

When rating becomes "D", the test is terminated at that time.

<Fluorescent X-Ray Measurement>

As the pretreatment of a sample, 150 mg of a sample is precisely weighed and pressure-molded at 5 t/cm$^2$ for 1 minute in a pressure molding device to produce a disc-like measurement sample of 10 mm in diameter.

The molded sample is measured for the Net intensity (kcps) value that is the X-ray yield derived from each element, by a wavelength dispersion-type fluorescent X-ray analyzer XRF-1500 (manufactured by Shimadzu Corporation) under the measurement conditions of Rh target, tube voltage of 40 KV, tube current of 70 mA and measurement time of 30 minutes.

The value of (Net intensity value of zinc Zn)÷(Net intensity value of carbon C) is calculated from the measurement results and defined as a Net intensity ratio (Zn/C).

Test results are shown in Table 2 below.

TABLE 1

| | Kind of Zinc Compound (number average particle diameter) | Kind of Sol-Gel Silica (number average particle diameter) | Free Zinc Compound Particle (% by number) | Average Circularity |
|---|---|---|---|---|
| Example 1 | Zinc Stearate 1 (4.2 μm) | Sol-Gel Silica 1 (150 nm) | 0.45 | 0.45 |
| Example 2 | Zinc Stearate 1 (4.2 μm) | Sol-Gel Silica 2 (65 nm) | 0.8 | 0.48 |
| Example 3 | Zinc Stearate 1 (4.2 μm) | Sol-Gel Silica 3 (240 nm) | 0.35 | 0.42 |
| Example 4 | Zinc Stearate 2 (2.3 μm) | Sol-Gel Silica 1 (150 nm) | 0.21 | 0.52 |
| Example 5 | Zinc Stearate 3 (9.5 μm) | Sol-Gel Silica 1 (150 nm) | 0.95 | 0.41 |
| Example 6 | Zinc Stearate 1 (4.2 μm) | Sol-Gel Silica 1 (150 nm) | 0.95 | 0.43 |
| Example 7 | Zinc Stearate 1 (4.2 μm) | Sol-Gel Silica 1 (150 nm) | 0.77 | 0.44 |
| Comparative Example 1 | Zinc Stearate 1 (4.2 μm) | Sol-Gel Silica 4 (40 nm) | 1.4 | 0.47 |
| Comparative Example 2 | Zinc Stearate 1 (4.2 μm) | Sol-Gel Silica 5 (300 nm) | 0.18 | 0.55 |
| Comparative Example 3 | Zinc Stearate 4 (1.8 μm) | Sol-Gel Silica 1 (150 nm) | 0.13 | 0.52 |
| Comparative Example 4 | Zinc Stearate 5 (10.5 μm) | Sol-Gel Silica 1 (150 nm) | 1.3 | 0.35 |
| Comparative Example 5 | Zinc Stearate 6 (3.8 μm) | Sol-Gel Silica 1 (150 nm) | 0.82 | 0.68 |

TABLE 2

| | Net Intensity Ratio Zn/C of Toner and Collected Material (R2/R1) | | | Color Streak Contamination | | | Image Slippage | | |
|---|---|---|---|---|---|---|---|---|---|
| | After 20,000 Sheets in Total | After 40,000 Sheets in Total | After 60,000 Sheets in Total | After 20,000 Sheets in Total | After 40,000 Sheets in Total | After 60,000 Sheets in Total | After 20,000 Sheets in Total | After 40,000 Sheets in Total | After 60,000 Sheets in Total |
| Example 1 | 14.5 | 16.1 | 13.0 | A | B | B | A | A | B |
| Example 2 | 22.2 | 24.3 | 23.7 | A | A | A | A | A | A |
| Example 3 | 18.2 | 20.3 | 21.4 | A | A | A | A | A | A |
| Example 4 | 11.2 | 10.1 | 13.2 | B | B | C | A | A | A |
| Example 5 | 28.3 | 29.9 | 27.4 | A | A | A | A | B | B |
| Example 6 | 38.8 | 40.4 | 41.2 | A | A | A | C | C | C |
| Example 7 | 32.1 | 33.3 | 30.6 | A | A | A | B | C | C |
| Comparative Example 1 | 33.6 | 33.1 | 34.7 | A | A | A | B | C | D |
| Comparative Example 2 | 9.6 | 13.0 | 11.4 | B | C | D | A | A | A |
| Comparative Example 3 | 8.2 | 7.5 | stopped | C | D | stopped | A | A | stopped |
| Comparative Example 4 | 44.8 | 46.4 | stopped | A | A | stopped | C | D | stopped |

TABLE 2-continued

| | Net Intensity Ratio Zn/C of Toner and Collected Material (R2/R1) | | | Color Streak Contamination | | | Image Slippage | | |
|---|---|---|---|---|---|---|---|---|---|
| | After 20,000 Sheets in Total | After 40,000 Sheets in Total | After 60,000 Sheets in Total | After 20,000 Sheets in Total | After 40,000 Sheets in Total | After 60,000 Sheets in Total | After 20,000 Sheets in Total | After 40,000 Sheets in Total | After 60,000 Sheets in Total |
| Comparative Example 5 | 16.2 | 18.3 | 16.2 | B | C | D | A | B | B |

What is claimed is:

1. An electrostatic image developing toner comprising:

a toner mother particle that contains a binder resin and a releasing agent; and an external additive that contains a zinc compound particle and a silica particle, wherein:

the zinc compound particle has a number average particle diameter of from about 2.0 μm to about 10.0 μm, the silica particle has a number average particle diameter of from 100 nm to 200 nm, the number of free zinc compound particles in all toner particles is from about 0.2% by number to about 1.0% by number, the free zinc compound particle has an average circularity of about 0.6 or less, the silica particle is obtained by a sol-gel process, and the electrostatic image developing toner contains no charge control agent in the mother particle.

2. The electrostatic image developing toner as claimed in claim 1, wherein the binder resin contains a polyester resin in an amount of about 50 wt % or more based on the entire amount of the binder resin.

3. The electrostatic image developing toner as claimed in claim 1, wherein a zinc compound of the zinc compound particle has a melting temperature of from about 40° C. to about 200° C.

4. The electrostatic image developing toner as claimed in claim 1, wherein a zinc compound of the zinc compound particle is zinc stearate.

5. The electrostatic image developing toner as claimed in claim 1, wherein a content of the zinc compound particle is from about 0.05 part by weight to about 3 parts by weight per 100 parts by weight of the toner mother particle.

6. The electrostatic image developing toner as claimed in claim 1, wherein an amount of the silica particle added is from about 0.05 part by weight to about 3 parts by weight per 100 parts by weight of the toner mother particle.

7. The electrostatic image developing toner as claimed in claim 1, wherein the silica particle is a spherical silica granulated by a sol-gel process.

8. The electrostatic image developing toner as claimed in claim 1, which has a volume average particle diameter $D_{50}$ of from about 4 μm to about 13 μm.

9. The electrostatic image developing toner as claimed in claim 1, which has a volume average particle size distribution index GSDv of about 1.28 or less.

10. An electrostatic image developer comprising:

the electrostatic image developing toner as claimed in claim 1; and a carrier that contains a resin and a magnetic core particle coated with the resin.

11. The electrostatic image developer as claimed in claim 10, wherein the magnetic core particle has an average diameter of from about 30 μm to about 200 μm.

12. The electrostatic image developer as claimed in claim 10, wherein carbon black is added to the resin of the carrier.

13. The electrostatic image developer as claimed in claim 10, wherein an amount of the resin is from about 0.1 part by weight to about 10 parts by weight per 100 parts by weight of the magnetic core particle.

14. The electrostatic image developing toner as claimed in claim 1, wherein the free zinc compound particle has an average circularity of from about 0.4 to about 0.6.

15. The electrostatic image developing toner as claimed in claim 1, wherein the content of the zinc compound particle is from about 0.1 part by weight to about 0.3 part by weight per 100 parts by weight of the toner mother particle.

16. The electrostatic image developing toner as claimed in claim 1, wherein the silica particle has a number average particle diameter of from 150 nm to 200 nm.

17. An image forming method comprising:

forming an electrostatic latent image on a latent image holding member surface;

developing the electrostatic latent image formed on the latent image holding member surface with an electrostatic image developer to form a toner image;

transferring the toner image formed on the latent image holding member surface onto a transfer-receiving material surface;

fixing the toner image transferred onto the transfer-receiving material surface; and collecting a residual material on the latent image holding member surface by means of a cleaning blade after the transferring of the toner image, wherein the electrostatic image developer is the electrostatic image developer as claimed in claim 10.

* * * * *